United States Patent [19]

Nardi

[11] Patent Number: 5,039,290

[45] Date of Patent: Aug. 13, 1991

[54] ROTARY EXPANDER

[76] Inventor: Anthony P. Nardi, 9 Willow Way, Burlington, Mass. 01803

[21] Appl. No.: 303,748

[22] Filed: Jan. 30, 1989

[51] Int. Cl.[5] ..... F01C 1/00

[52] U.S. Cl. ..... 418/225; 418/58; 418/227

[58] Field of Search ..... 418/61.1, 58, 227, 225

[56] References Cited

U.S. PATENT DOCUMENTS

| | | | |
|---|---|---|---|
| 525,121 | 8/1894 | Shepard | 418/225 |
| 1,214,981 | 2/1977 | Wikander | 418/225 |
| 2,454,006 | 11/1948 | Plummer | 418/227 |
| 3,053,193 | 9/1962 | Fischer | 418/227 |
| 3,756,755 | 9/1973 | Campbell | 418/227 |
| 3,865,522 | 2/1975 | Nardi | 418/225 |

FOREIGN PATENT DOCUMENTS

| | | | |
|---|---|---|---|
| 2235607 | 1/1975 | France | 418/227 |

*Primary Examiner*—Leonard E. Smith
*Assistant Examiner*—David L. Cavanaugh
*Attorney, Agent, or Firm*—Samuels, Gauthier & Stevens

[57] ABSTRACT

A positive displacement single expansion steam expander engine. Cylinder heads are fixed to the wall of the engine. A rotatable power shaft assembly has a plurality of nests. Received in each of the nests is a free-floating piston (nonengaged) having lobes which allows free movement of the pistons in the nests.

12 Claims, 14 Drawing Sheets

122a
123a
122b
125b
122d
127c
122c
131c

VCH
48
STOPS
133a
129

FORWARD
75°
15°

137
139

ROTARY EXPANDER

BACKGROUND OF THE INVENTION

Rotary steam engines are well known in the art. Early constructions may be found in patents to Fisher U.S. Pat. No. 137,065; Shepard U.S. Pat. No. 525,121; Taylor U.S. Pat. No. 597,793; Taylor U.S. Pat. No. 949,605; Gross U.S. Pat. No. 968,653; and Conklin U.S. Pat. No. 1,270,498. See also Plummer U.S. Pat. No. 2,454,006; Farrell U.S. Pat. No. 3,109,382; Eyer U.S. Pat. No. 3,236,187; Nardi U.S. Pat. No. 3,865,522 and Gardiner U.S. Pat. No. 4,393,829.

In this type of steam engine there is no reciprocating piston. Instead each piston is permanently attached to the rotating cylinder walls and moves continuously in one direction. The inner transverse edge of each piston engages and slides along the cylindrical surface of a stationary inner body. The inner body carries a plurality of rotatable elements (ordinarily one more than the number of pistons) mounted for rotation in a succession of cavities in the inner body.

The rotatable elements act to form the ends of the curved cylinders. The construction permits the piston on reaching the end of its stroke, to pass the rotatable element to move into the next cylinder.

The radially outermost part of each rotatable element forming the end of the cylinder is in steam tight sliding engagement with the rotating walls of the cylinder.

In order that the piston may pass the rotatable element, it is essential that the piston and the rotatable element be in a form which might be said to be roughly in the nature of paired gear teeth. Thus the piston would represent an internal tooth, designed to cooperate with external teeth on the rotatable element.

In some of the early forms disclosed in the prior art, it was considered desirable to gear the rotating part of the engine to the rotatable element in such manner that when the piston reached the rotatable element, the latter would be positively rotated by the gearing so that the piston would enter a complementary cavity in the rotatable element and thus to pass thereby. In other forms in the prior art, the piston came into positive engagement with one of the stationary blades of the rotatable element and forced the blade to rotate, thereby permitting passage of the piston into the next curved cylinder.

In all of the prior constructions, the shape of the piston and the shape of the blades of the rotatable elements did not provide for efficient passage of the piston past the rotatable element. There was a leakage of steam, excessive condensation, undue wear of the engaging portions, inefficiency in the location of the exhaust ports, inefficiency in the performance of the steam admission ports and inability to change the time of steam cut-off.

In my prior invention, U.S. Pat. No. 3,865,522, the piston was attached to the outer walls of the engine with its inner edge slideable along the cylindrical surface of the inner fixed body, generally in the form of a smaller gear tooth of different configuration. The rotatable element which permitted the passage of the piston had four blades generally in the shape of large gear teeth. At the root of adjacent blades, the opposed surfaces were shaped in the form of two small adjacent teeth designed to cooperate closely with the small tooth on the inner end of the piston. The major portion of each wall blade had substantially the reverse configuration of the walls of the piston.

Thus, as the piston came close to the face of the blade which was then acting as the end of the curved cylinder and with the exhaust port closed, the pressure generated between the piston and the blade wa usually sufficient to induce starting rotation of the blade. Immediately after the start of rotation, the tooth formation on the inner end of the piston reached its position of engagement in the previously referred to tooth formations that are at the roots of the adjacent blade surfaces. Thus the blade was started in its rotation by the rising pressure between the piston and the blade surface and was compelled to continue its rotation by the engagement of the small toothed end of the piston with the corresponding tooth formation between adjacent blades. If the pressure between the piston and blade was insufficient to start rotation, the piston engaged the blade at its outer end to compel rotation. The shape of the engaging surfaces was such that they rolled against each other until the small inner teeth took over.

There were two pistons spaced 180° apart and three rotatable elements (each with four blades) spaced 120° apart. Thus there was always at least one steam cylinder in operation and there was never be any position of dead center. As a result, the rotation of the outer part of the engine was continuous and the driving force provided by the steam was substantially uniform. The rotating outer part of the engine acted as a fly wheel and maximum torque was always available from 0 rpm to top speed.

My present invention differs from my prior invention and involves three basic changes. In the present invention, the outer housing is stationary and not rotational; the piston, which I refer to in this disclosure as a virtual piston, is a free floating piston and has no shaft. In my prior invention, it was confined by a shaft. Lastly, the valving in the cylinder head is distinct.

Broadly my invention is a positive displacement, single expansion true steam expander, like the tubine i.e., it has no compression cycle. The engine is designed to operate on saturated steam at moderate temperatures and pressures (475° F. and 500 psi). At these temperatures, a 5% mixture of lubricating oil may be admitted to the steam directly. In general terms, my engine can be classified as a postive displacement turbine.

A steam turbine's longevity (20 years) is based on 100% fixed gap clearance; i.e., no metal to metal contact. The present invention has a fixed gap clearance of about 80%. The remaining components are pressure balanced which minimizes metal to metal contact.

The engine of the preferred embodiment has a high power/weight ratio (2 lbs./HP - least admission, 0.5 lbs./HP full full admission). It is equivalent to a 12 cylinder IC engine because there are 6 power strokes per revolution. Furthermore, it has a wide power range—0.05—1 megawatt and its thermal efficiency is not a first order function of RPM.

In the present invention, cylinder heads are fixed to the outer wall of the engine. The inner edge of the cylinder head has a fixed gap and discrete seal which is slidable along the cylindrical surface of a rotatable power shaft assembly, which shaft has a plurality of nests. Received in each of the nests is a virtual piston having lobes which allow free movement of the pistons in the nests, the outer edges of the lobes in sliding engagement with the inner surface of the nest and the inner surface of the fixed outer wall of the engine. Further, the opposed surface defined by adjacent lobes cooperates closely with the outer surface of the cylinder head. Thus, the major portion of each piston lobe has substantially the reverse configuration of the walls of the cylinder head. However, the design is such that an acceleration/deceleration ramp is in the compression/ admission cycles The virtual piston within the nest is balanced at all times (except when in contact with the cylinder head). Specifically, a seal on the cylinder head vertex effectively reduces the area on the face of contact about its axis of rotation within the nest but is imbalanced with reference to the center of rotation of the tri-nested power shaft assembly. Upstream of the cylinder head is an exhaust port. As the facing surface of a first lobe approaches the exhaust port, a chamber is defined by the inner surface of the stationary wall, the surface of the cylinder head opposing the facing surface of the lobe, the outer surface of the power transfer shaft and the surface of the lobe next preceeding the first lobe. As the first lobe passes the exhaust port, the exhausting ceases and compression commences in the newly defined volume. The shaft assembly continues to rotate in a counterclockwise direction, while clockwise rotation is imparted to the virtual piston by virtue of the compression building up in the diminishing volume. As rotation continues, the first lobe engages the opposed surface of the cylinder head.

The shaft assembly continues to rotate in the counterclockwise direction. The virtual piston always rotates in the clockwise direction. A new volume is defined on the other side of the cylinder head between the surface of the next preceeding lobe facing the opposed cylinder head surface, and the facing surface of the first lobe. Steam is introduced from the cylinder head into this volume tending to drive the free piston in a counterclockwise direction. The piston is unbalanced but cannot rotate in a counterclockwise direction because it is prevented from doing so at this time by contact with the vertex of the cylinder head. The force created by the introduction and expansion of the steam in the closed chamber continues to drive the shaft assembly in the same direction (ccw).

In the preferred embodiment, there are two cylinder heads spaced 180° apart and three virtual pistons spaced 120° apart. Thus, there is always at least one steam cylinder in operation and there never will be any postion of dead center. As a result, the rotation of the inner shaft assembly is continuous and the driving force provided by this stream is substantially uniform.

Figure 10:
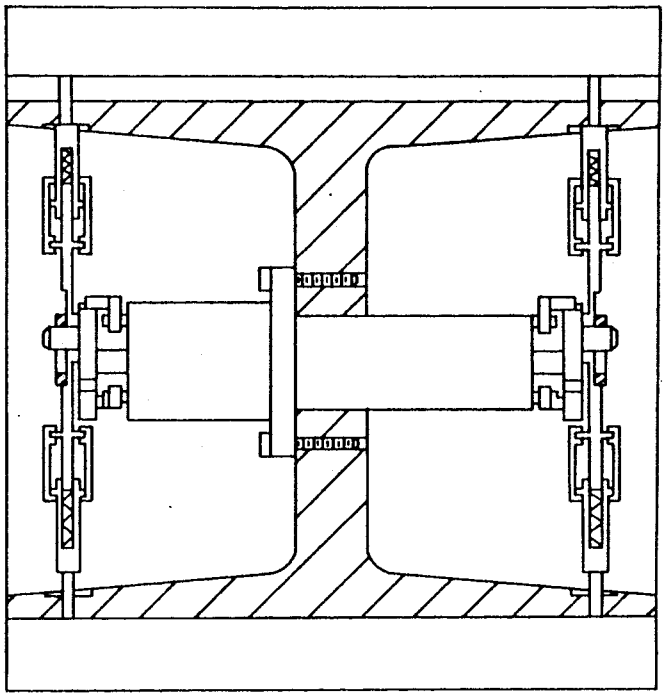
Figure 9:
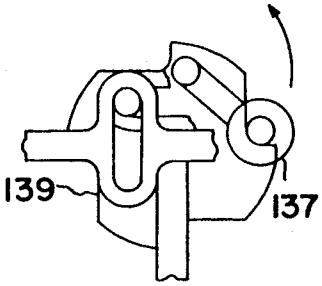
Figure 8:
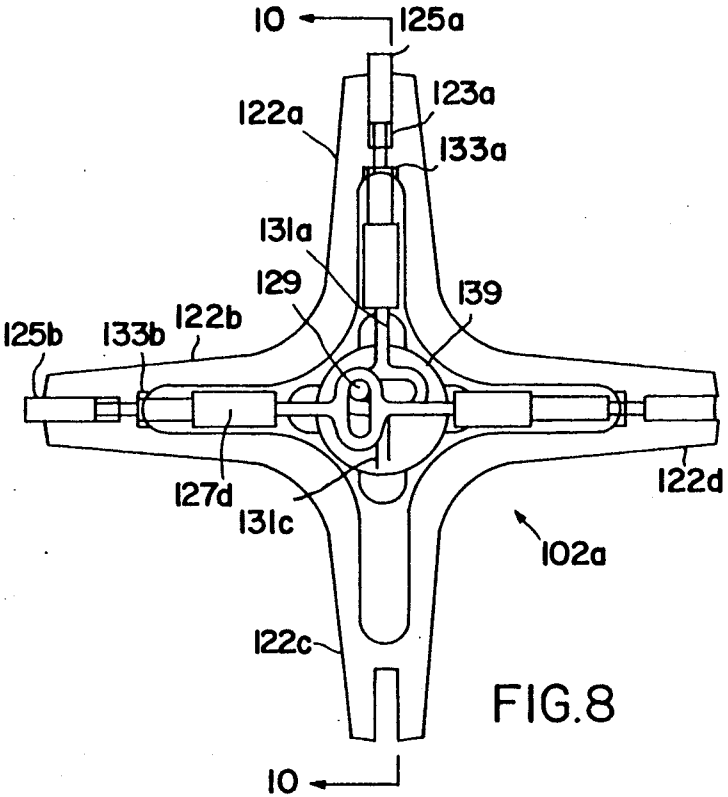
Figure 13:
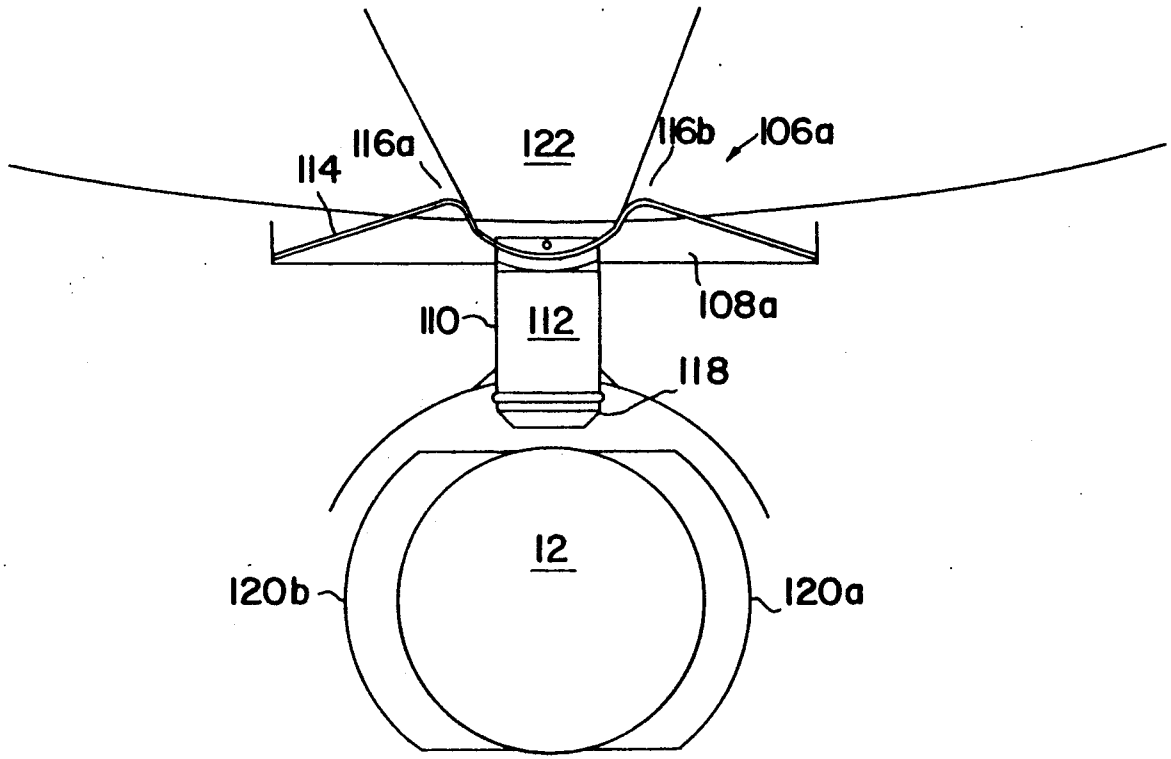
Figure 12:
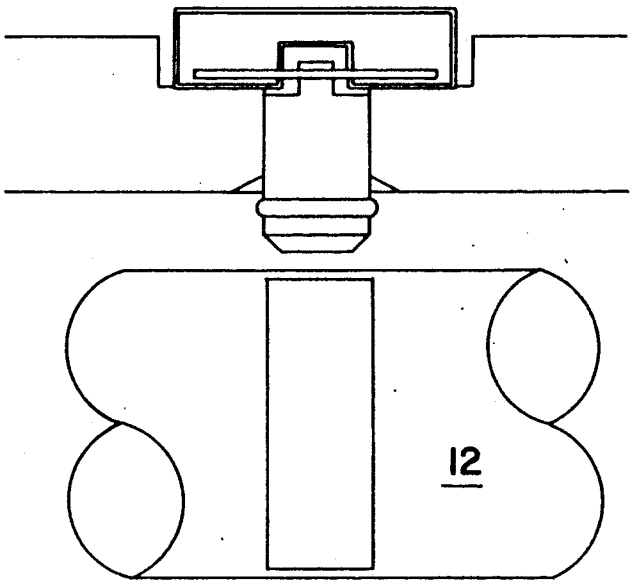
Figure 15B:
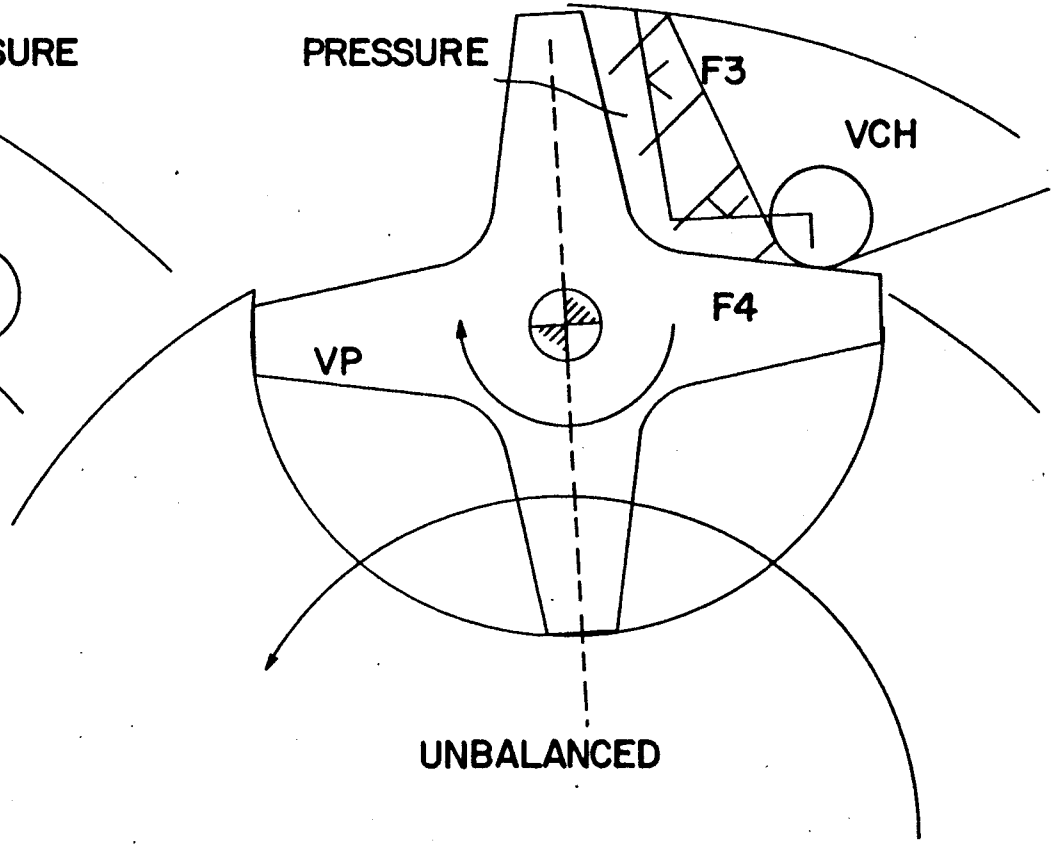
Figure 15A:
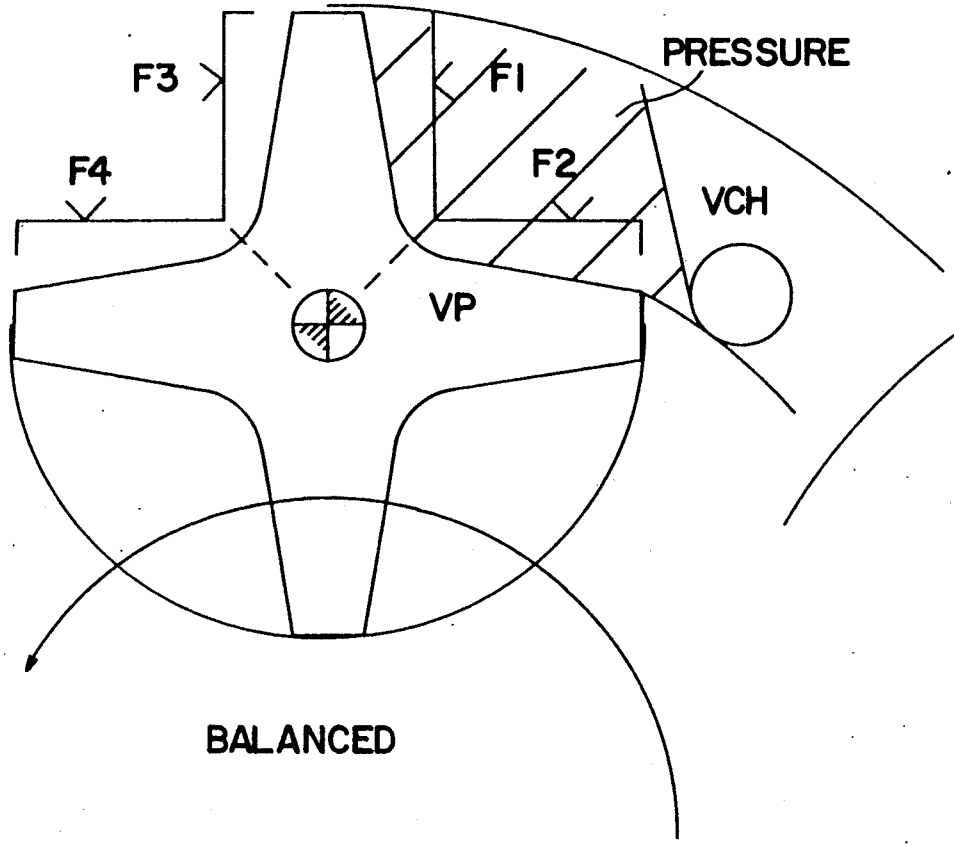
Figure 16:
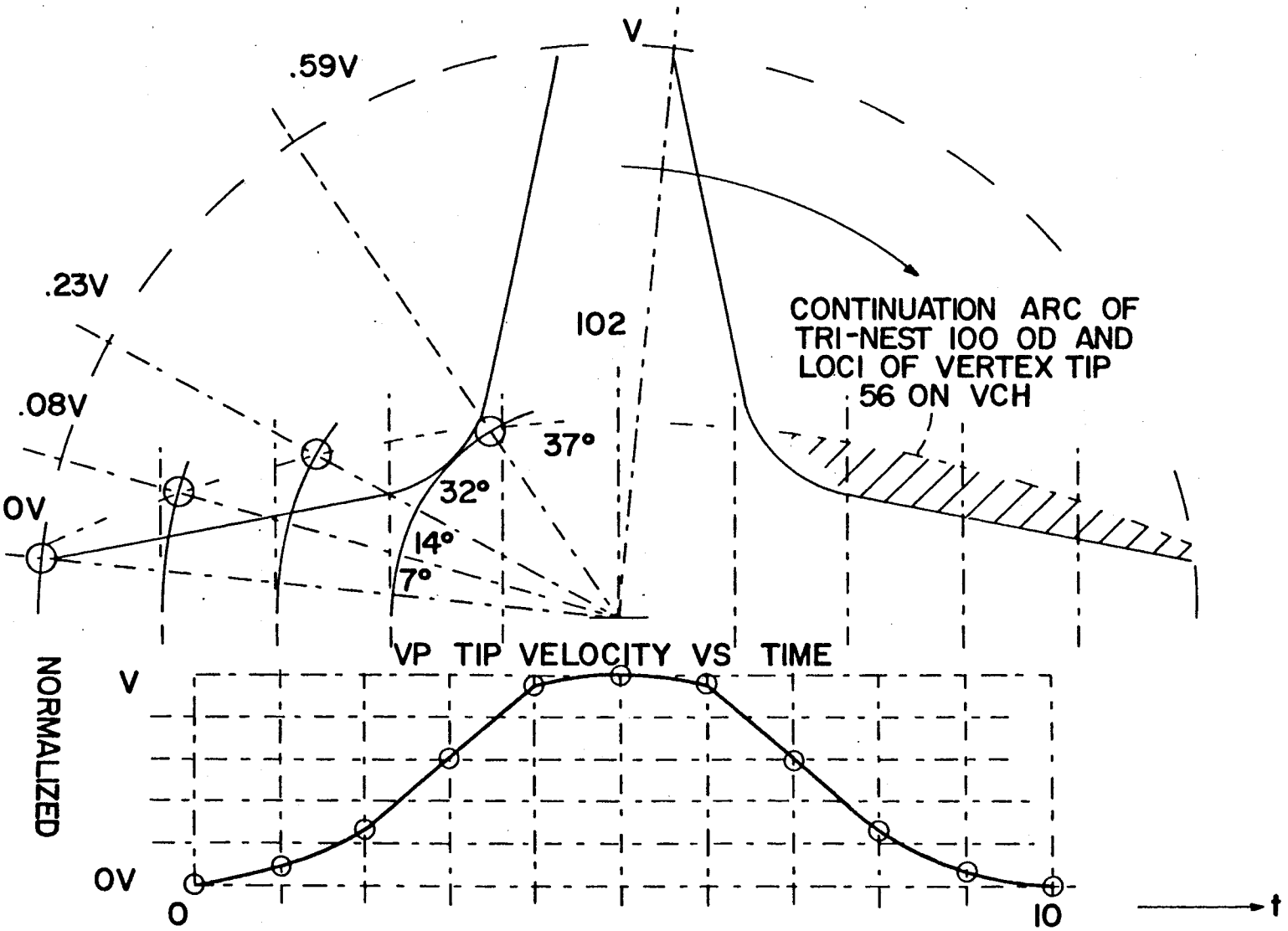

FIGS. *7a–7d* are schematics of the camming cycle;

FIG. 8 is a front view of a piston;

FIG. 9 is an exploded of a ratchet assembly of FIG. 8;

FIG. 10 is a side view of FIG. 8 taken along lines 10—10;

FIGS. 11*a*–11*d* are schematics of the piston seal;

FIG. 12 is an illustration of an alignment assembly for the virtual piston;

FIG. 13 is a side illustration of the alignment assembly;

FIGS. 14*a*–14*h* are illustrations of the compression-exhaust cycles of the engine;

FIGS. 15*a*–15*b* are illustrations of the balance relationship of the piston within the nest and in relation to the shaft assembly; and FIG. 16 is a graph illustrating the ramped acceleration/deceleration profile of the virtual piston when in the vicinity of the virtual cylinder head.

DESCRIPTION OF THE PREFERRED EMBODIMENT

Figure 4:
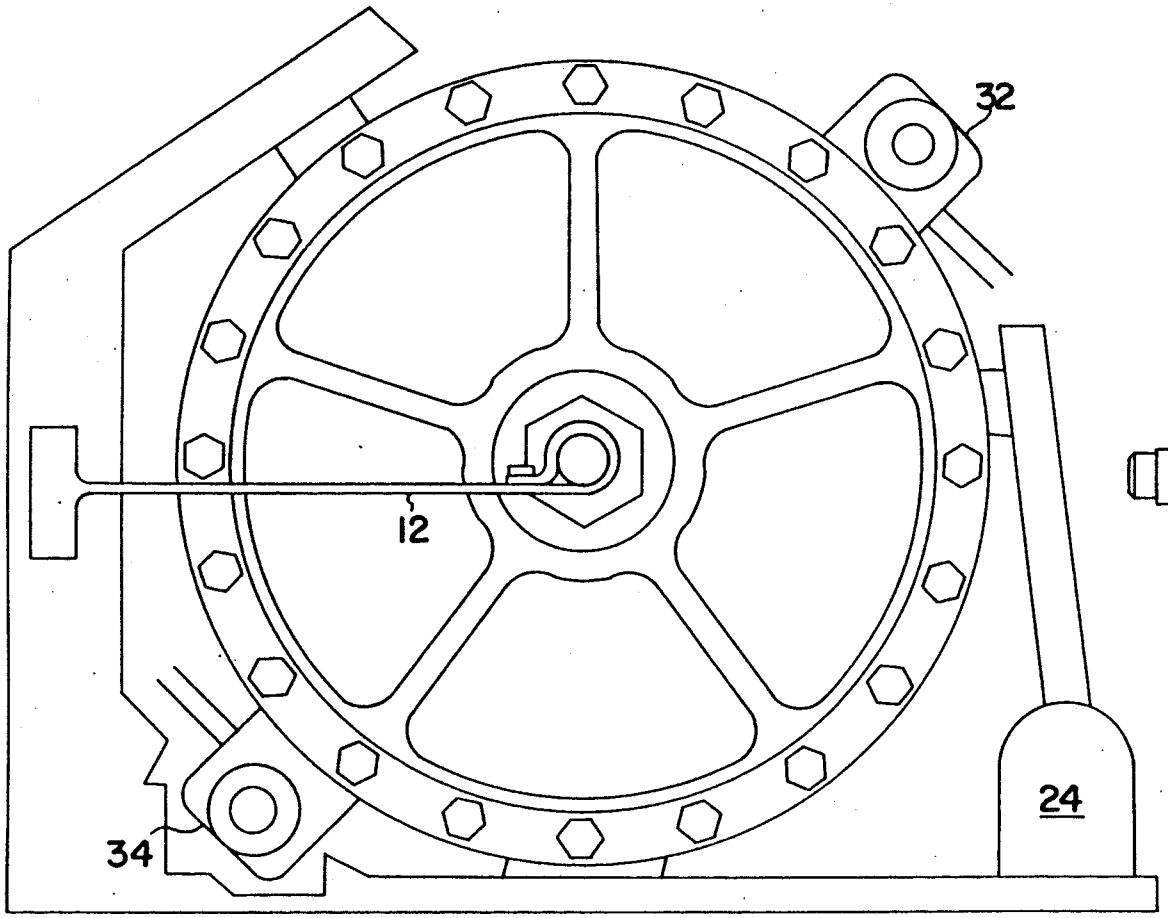
FIG. 4 is a front view of the engine.

Referring to FIGS. 1 through 4, an engine is shown generally at 10 and is supported on the outside diamater of a sleeve 22 which in turn is carried by a suitable frame 24. A tubular power shaft 14 is supported by two opposed taper roller bearings 30 and securing nuts 18 (see FIG. 3). Face plates 28 are received over the power shaft and carried on bearings 30. The sleeve 22 is secured between the face plates 28. The face plates and sleeve are bolted together in a fluid tight manner and secured against axial and rotatable movement by the threaded nuts 18 on the shaft 14 which abuts the outer face of each bearing 30. The frame 24 also secures the sleeve 22 at three locations as shown in FIG. 4. Secured to the sleeve 22 are two sets of pillow blocks 32 and 34, each set being identical, only one will be described in detail. The set 32 supports a timing shaft 20 which is driven by the power output shaft 14 via a belt 36.

Figure 2:
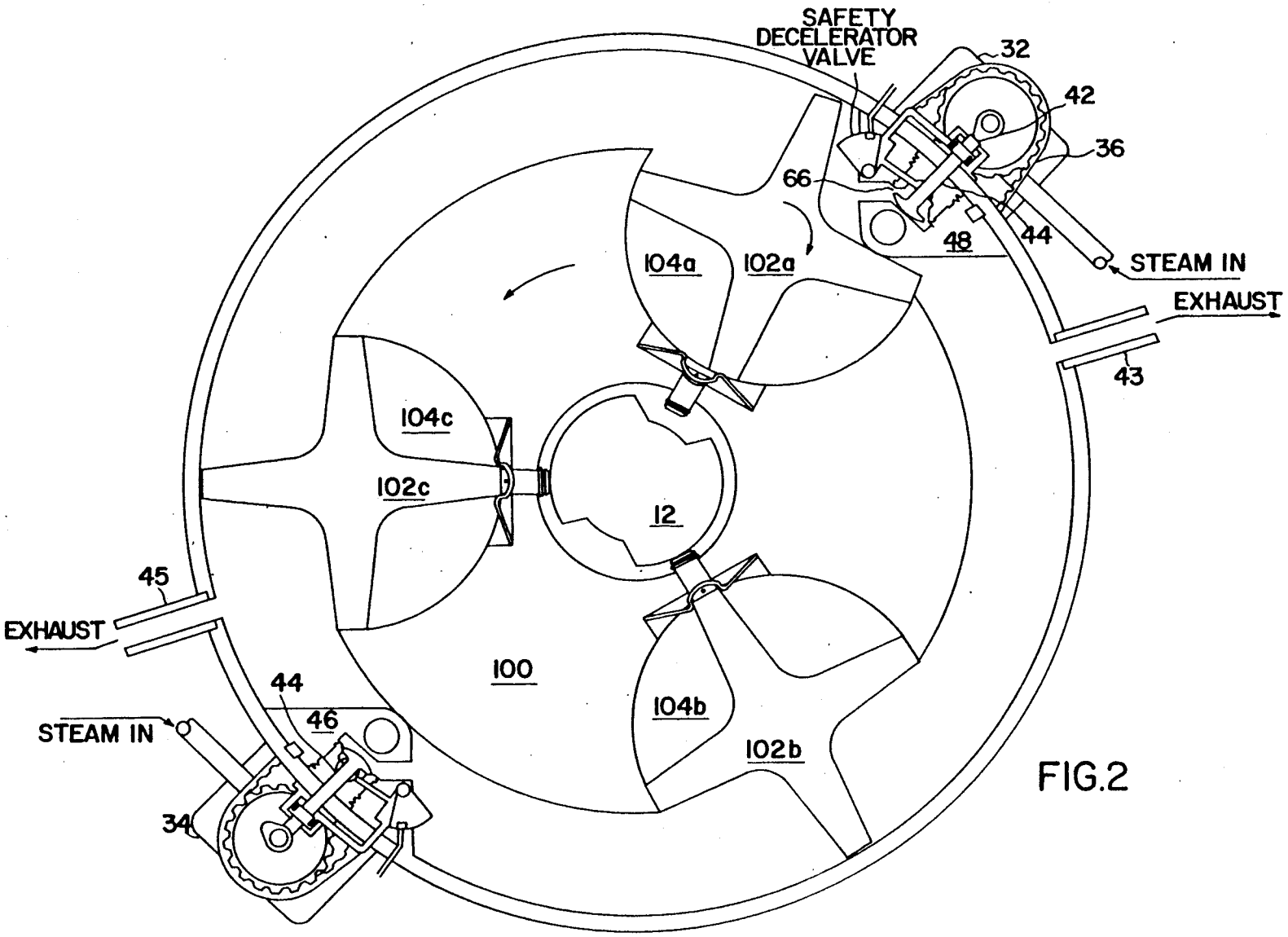
FIG. 2 is a front schematic view of the engine.
Figure 3:
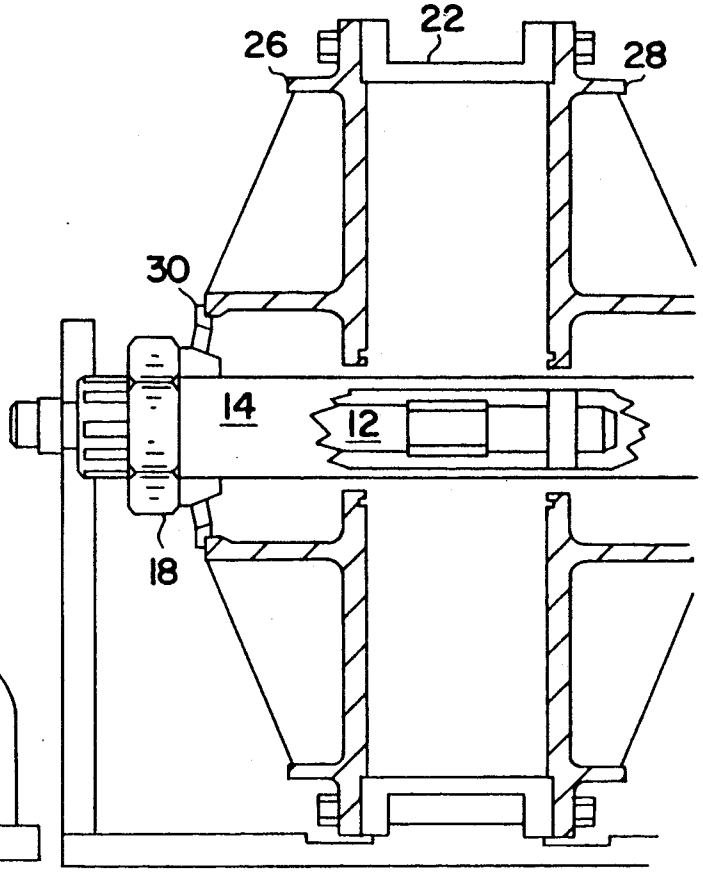
FIG. 3 is a side sectional view of the engine.

Referring to FIG. 2, the set 32 has contained therein a timing belt 36 which in turn drives cams 42. The cams engage poppet valves 44.

Secured to the inner surface of the sleeve 22 are cylinder heads 46 and 48, 180° apart. Upstream of the cylinder heads, 180° apart, are exhaust ports 43 and 45. In that the cylinder heads are identical, only one will be described in detail.

Figure 5:
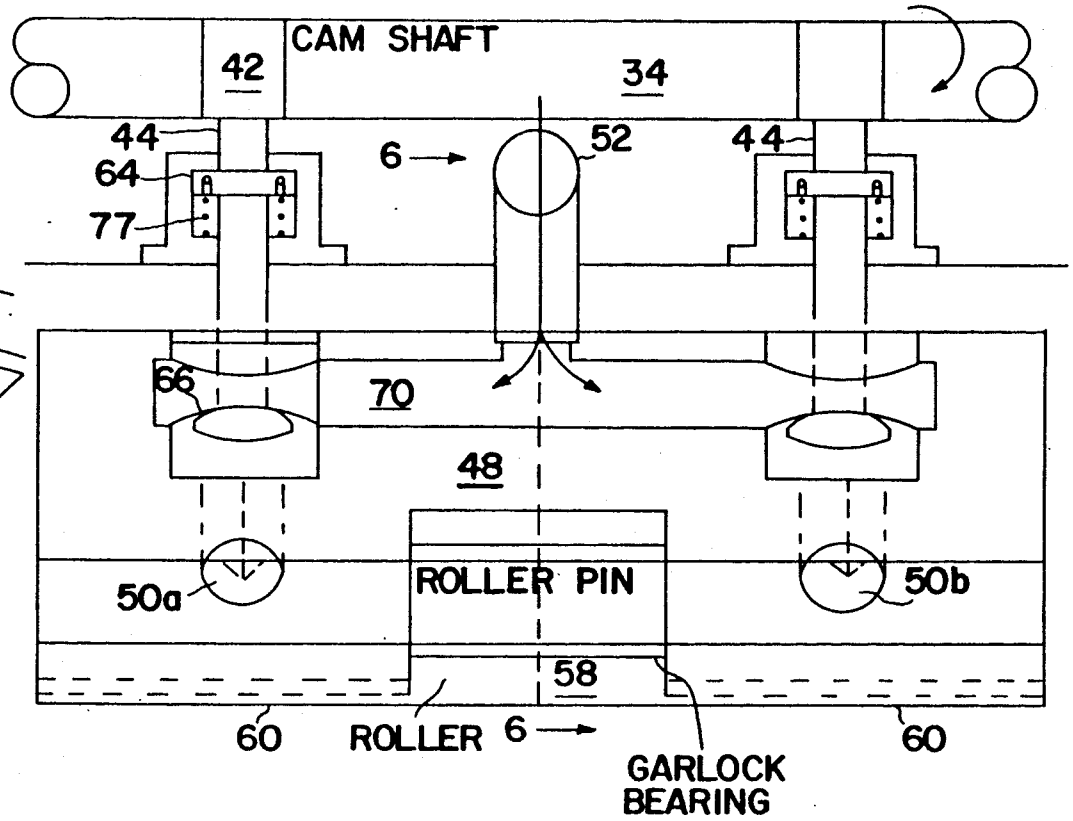
FIG. 5 is a schematic of the cylinder head.
Figure 6:
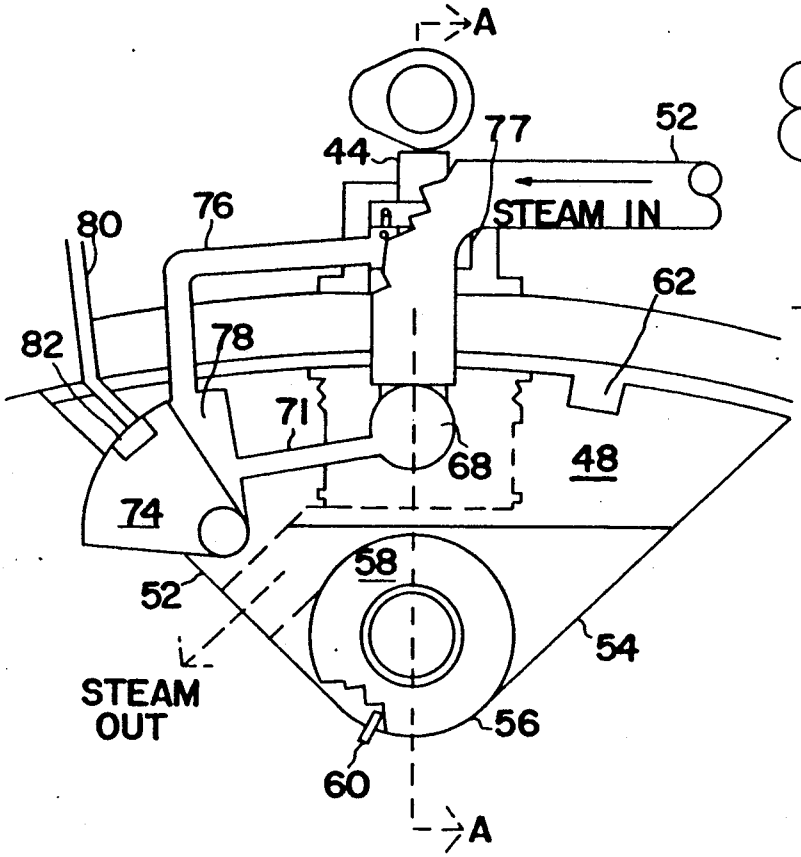
FIG. 6 is a view of FIG. 5 taken along lines 6—6.
Figures 7A, 7B, 7C, 7D:
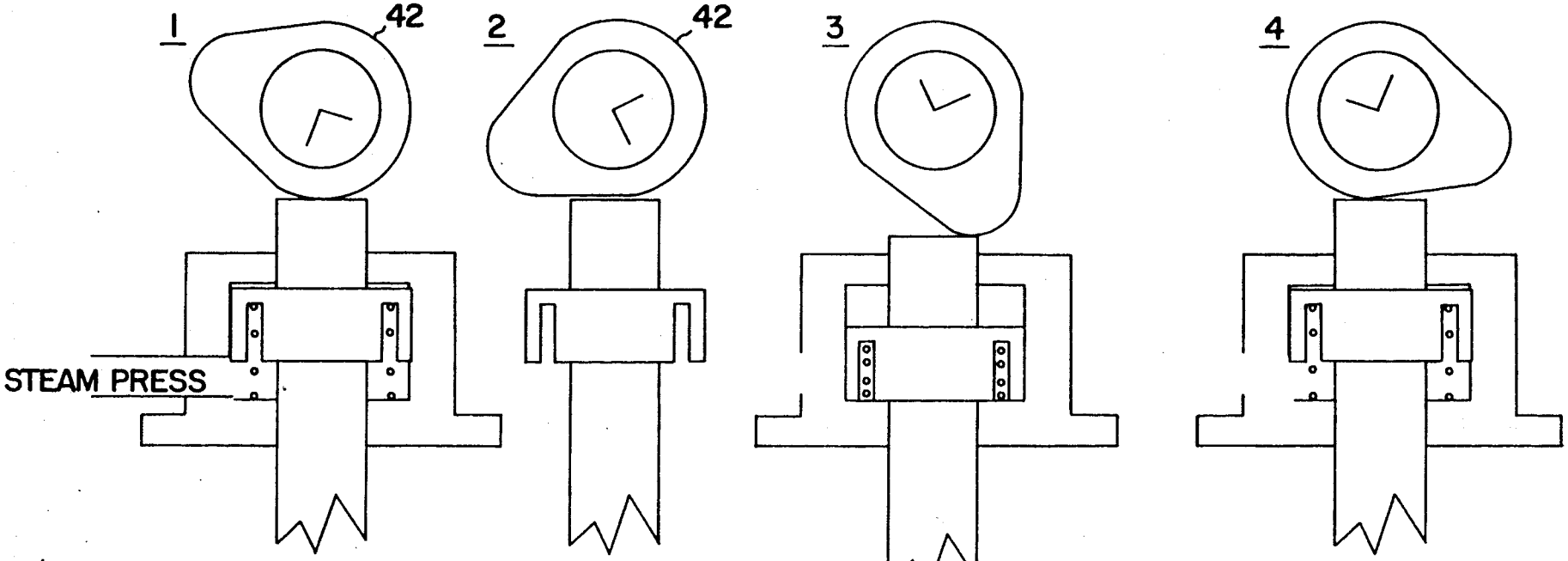

Referring to FIGS. 5 and 6, the cylinder head 48 has two steam discharge ports 50*a* and 50*b* and is fed by the steam line 52. The cylinder head 48 comprises a V-shaped body, when viewed in cross section, having sloped surfaces 52 and 54 joined at a curved vertex 56. The head 48 includes a central recess in which is pinned a roller 58. This provides a rolling seal when the face of a lobe engages the cylinder head. In the vertex 56, grooves are cut from the outer edges of the cylinder head to the walls which define the recess. Static seals 60 are received in these grooves, their lower edges lying in the same plane as the circumference of the roller 58. Further, in securing the cylinder head to the sleeve 22, it is keyed to the sleeve 22 with key 62 and then bolted. The key 62 is necessary to accommodate the force generated in the admission cycles.

The valve 44 is secured in a collar 64 and is spring and pressure biased to a closed position to engage the seat 66. The valve stem passes through a steam chamber 70 in a moveable seal tight manner. Steam flows into the chamber 70 from line 52. In the power stroke the cams 42 drive the valves 44 open and the steam is fed through the ports 50*a* and 50*b* to drive the virtual piston, as will be described.

At all times the steam flows from the chamber 70 into a valve balancing chamber 78 via passageway 71. If for some reason, steam admission is delayed, the virtual piston would have mechanical deceleration. For this reason a safety valve 74 is pivotally secured in the valve balancing chamber 78, and in normal operation, it is wedged in a closed position as shown to seal off a vent port 80. Line 76 provides steam pressure for the chamber 77 to bias the collar 64 upwardly. The valve 74 includes a groove 82. If there is a malfunction, the safety valve 74 rotates to provide communication between port 80 and passageway 76 in which to vent the steam to atmosphere. The groove 82 in the valve bridges both passageway 72 and port 80 allowing this to happen. The spring, without the assist of the steam pressure, cannot maintain the valve 44 closed.

In the preferred embodiment, referring to FIGS. *7a–7d* for the admission timing sequence, rotation of the cams 42 is three times that of the engine, i.e. 1080° of cam angle is equal to 360° of engine angle (one engine revolution. "0" degrees engine angle is shown in FIG. *14e*. The virtual piston at that point is half way (45°) through its 90° motion. The admission cycle is repeated every 60°, i.e. six times per engine revolution: three at cylinder head 46 and three at cylinder head 48. "0" degrees, cams 42 are shown in FIG. *7b*. The lobe of the cam is at 8:00 o'clock or 210° in standard scientific notation. Prior to the formation of the volume V2, referring to FIG. *14g*, the pressure in this vicinity is atmospheric (non-condensing) because of paths to exhaust ports 43 and 45. Steam pressure (500 psi) is admitted to the volume V2 through valve 44. Atmospheric pressure continues to exist outside of the volume V2.

| | | Timing Table | | |
|---|---|---|---|---|
| Engine Angle | Cam 38 angle | Function | Cam Angle | function |
| | | | | I I |
| 0/360 | 1035 | | 855 | cut off |
| 15 | 0/1080 | admission | 900 | |
| 30 | 45 | I I | 945 | |
| 42 | | | | |
| 45 | 90 | I I | 990 | |
| 60 | 135 | cut off | 1035 | |
| 75 | 180 | | 0/1080 | admission |
| 90 | 225 | | 45 | I I |
| 102 | | | | |
| 105 | 270 | | 90 | I I |
| 120 | 315 | | 135 | cut off |
| 135 | 360 | admission | 180 | |
| 150 | 405 | I I | 225 | |
| 162 | | | | |
| 165 | 450 | I I | 270 | |
| 180 | 495 | cut off | 315 | |
| 195 | 540 | | 360 | admission |
| 210 | 585 | | 405 | I I |
| 222 | | | | |
| 225 | 630 | | 450 | I I |
| 240 | 675 | | 495 | cut off |
| 225 | 720 | admission | 540 | |
| 270 | 765 | I I | 585 | |
| 282 | | | | |
| 285 | 810 | I I | 630 | |
| 300 | 855 | cut off | 675 | |
| 315 | 900 | | 720 | admission |
| 330 | 945 | | 765 | I I |
| 342 | | | | |
| 345 | 990 | | 810 | I I |

Figure 1:
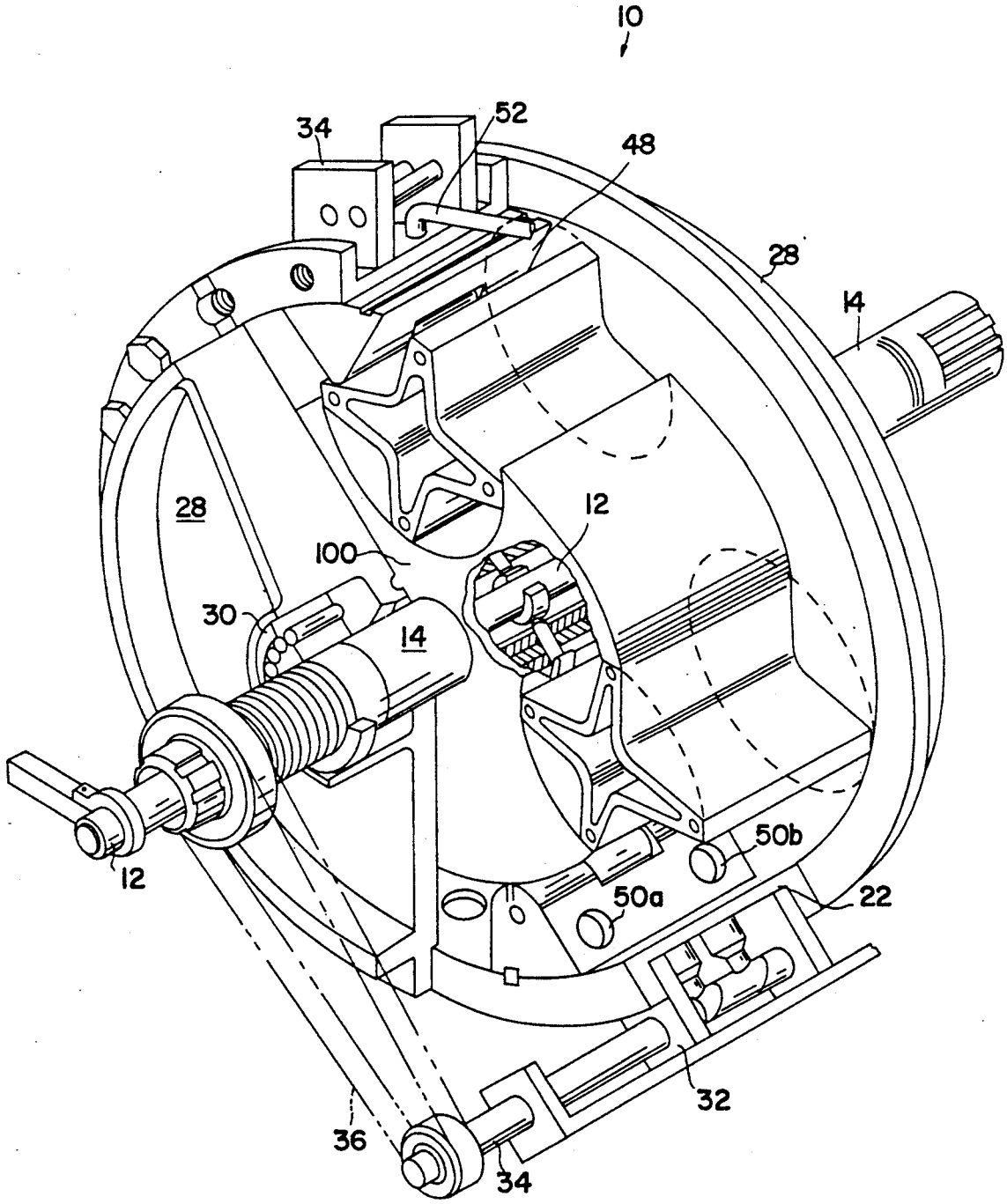
FIG. 1 is a perspective broken away view of an engine embodying the invention.

Referring to FIGS. 1 and 2, a tri-nested shaft assembly 100 is staked to the power shaft 14. As shown in FIG. 2, there are three identical semicircular nests 104*a*, 104*b* and 104*c* and received in these nests in floating engagement, when the engine is operating, are three virtual pistons 102*a*, 102*b* and 102*c*.

Referring to FIG. 8, a front view of the piston 102*a* is shown The piston has four lobes 122*a*, 122*b*, 122*c* and 122*d*. The lobes are dimensioned to ensure sliding sealing contact with the inner surface of the nests, the surfaces of the cylinder head and the opposed facing surfaces of the face plates 28.

Each of the lobes are characterized by recesses 123*a*, 123*b*, 123*c* and 123*d* respectively. Slideably received in each of these recesses are seals 125*a* through 125*d*. These seals are joined to compression springs 127*a* through 127*d* which are in turn are joined to four equal arms 131*a*–131*d* which arms are secured to an eccentric pivot 129 on a rotatable rachet 139 at the center of the piston 102*a*.

This structure provides a seal in the gap between the outward pointing tip of a lobe and the inner surface of the sleeve 22. Further, no part of the seal 125 that is on the lobe of the piston which is reentering the next area 104 must extend beyond the tip of the piston.

Figures 11A, 11B, 11C, 11D:
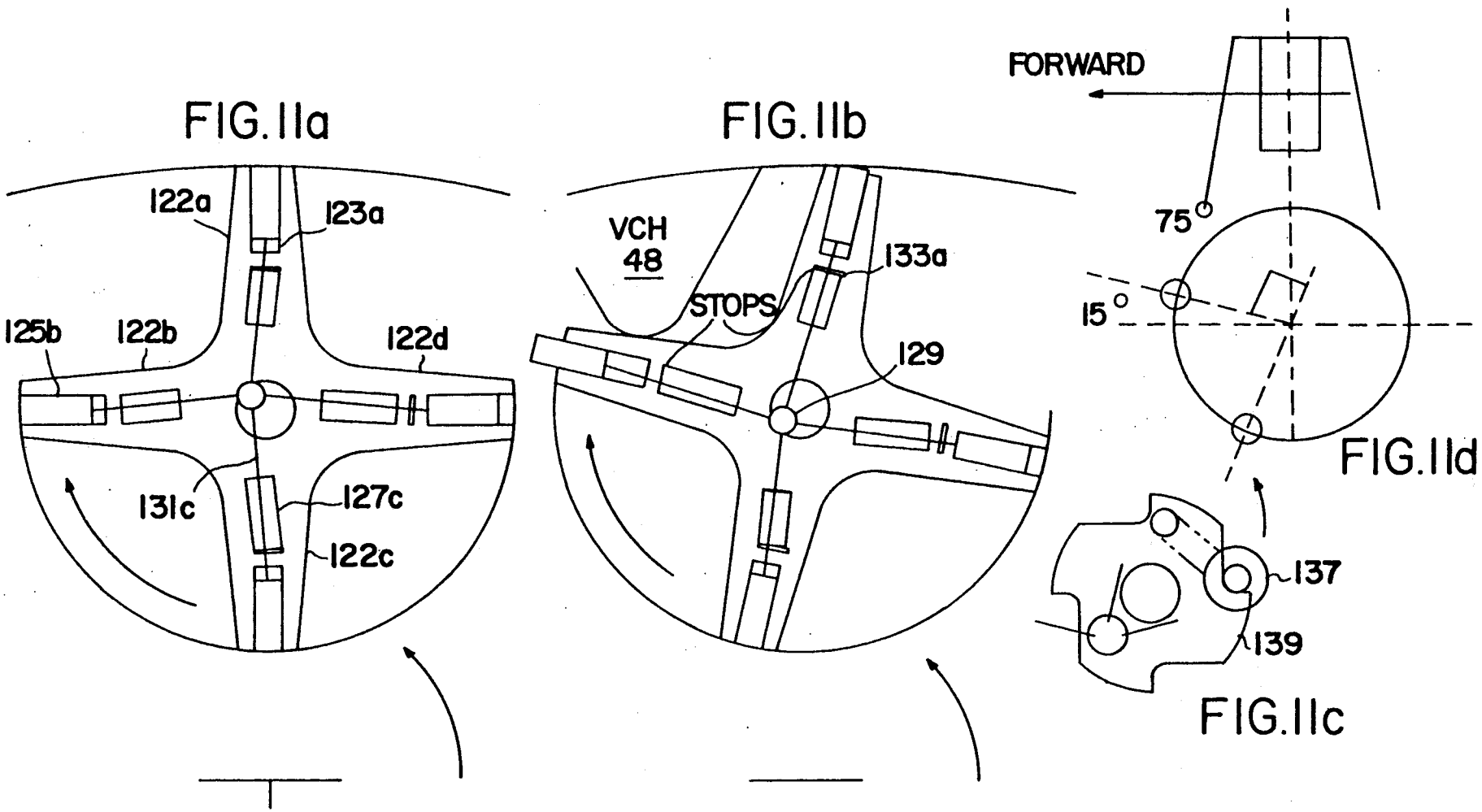

Four equally spaced stops 133*a*–133*d* provide the two following functions: 0.2" maximum extention of the seal beyond the lobe tip; and preload on the compression springs except on the single seal as shown on the leeward side of the piston in FIG. 11*d*.

An inertial, spring-loaded dog 137 is pivoted on the piston body. When the piston rotates in cooperation with the cylinder head, the resulting rotation/acceleration ejects the dog from engagement and allows a 90° rotation of the ratchet 139 opposite that of the piston rotation. Sequences shown in FIGS. 11*a* and 11*b* are repeated on each occasion at the interaction of the piston with the cylinder head. Sequence 1 is the actual compression of the spring 125*a* as it is forced into the seal slot when it contacts the inner wall of sleeve 22.

With the inertial dog 137 engaging the ratchet 139, as shown in sequence 1, spring 125*a* has been compressed. Spring 125*b* had been compressed by a previous sequence 2. Spring 125*c* is compressed but not as much as spring 125*b*. Spring 125*d* has no compression or force on eccentric. The angle configuration is shown in FIG. 11*d*. Rotation/acceleration, at engagement time of the piston and the cylinder head, allows two actions to occur simultaneously; full extension of spring 125*b* and ratchet release from the inertial dog. Since seal 125*a* has a longer contact period than seal 125*b*; spring 127*a* pushes the ratchet into the engagement as shown in FIG. 11*b*. The exact angles are shown in FIG. 11*d*. Spring 125*b* aids in this push because it has gone by the dead center position which promotes CCW rotation of the ratchet.

The pivot point of the inertial dog on the piston is at a lesser radius than the center of gravity of the dog (that portion that is in the ratchet pocket). Thus, the acceleration force tends to move the dog to the outside of the ratchet, the condition for release. The two positions of 90° of ratchet position are 15° offset from the normal quadrant of the piston. This allows a bi-stable condition to exist on eccentric dead center in order to effect the 90° push described above.

In the bottom of each nest 104*a*, 104*b* and 104*c* are received alignment assemblies 106*a*, 106*b* and 106*c* respectively. Referring to FIGS. 12 and 13, a slot-like recess 108 is formed in the bottom of the nest. A hole 110 passes through the recess 108 and the wall of the bottom of the nest 106*a*. Received in this hole is a plug 112 having a tapped hole in which is fastened a spring 114. The plug extends through the bottom of the nest and terminates with cammed surface 118. The walls of the recess also hold the spring in place. The spring 114 has arms with opposed surfaces 116*a* and 116*b*.

The spring normally biases the plug downwardly such that the spring does not extend into the plane defined by the inner surface of the revolution of the nest 104*a*. The stationary shaft 12 has cammed surfaces 120*a* and 120*b*. When the virtual pistons are not moving through an exhaust/compression cycle, the cams 120*a* or 120*b* engage the plug 112 moving the spring into the nest, the arms 116*a* and 116*b* retaining the lobe to maintain the piston in alignment.

Referring to FIGS. 1 and 2, the sleeve 22 has two fixed normally open exhaust ports 43 and 45 180° apart. In close proximity to the exhaust ports and also 180° apart are the two cylinder heads 46 and 48 each containing a pair of valves 44. The power take off is the shaft 14 keyed to the cylindrical tri-nested assembly shaft 100 carrying the three, four-lobed virtual pistons 102*a*, 102*b* and 102*c*. Each virtual piston in sequence has accelerated/decelerated motion only when in the vicinity of the cylinder heads. The acceleration/deceleration action forms the closed volumes necessary for the working steam.

Figure 14B:
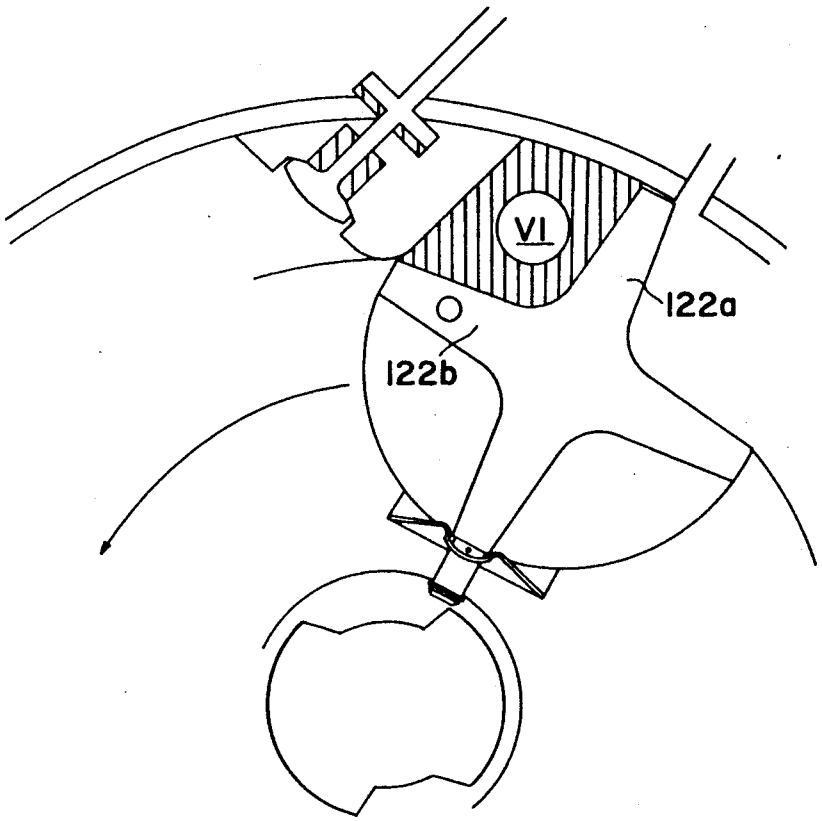
Figure 14A:
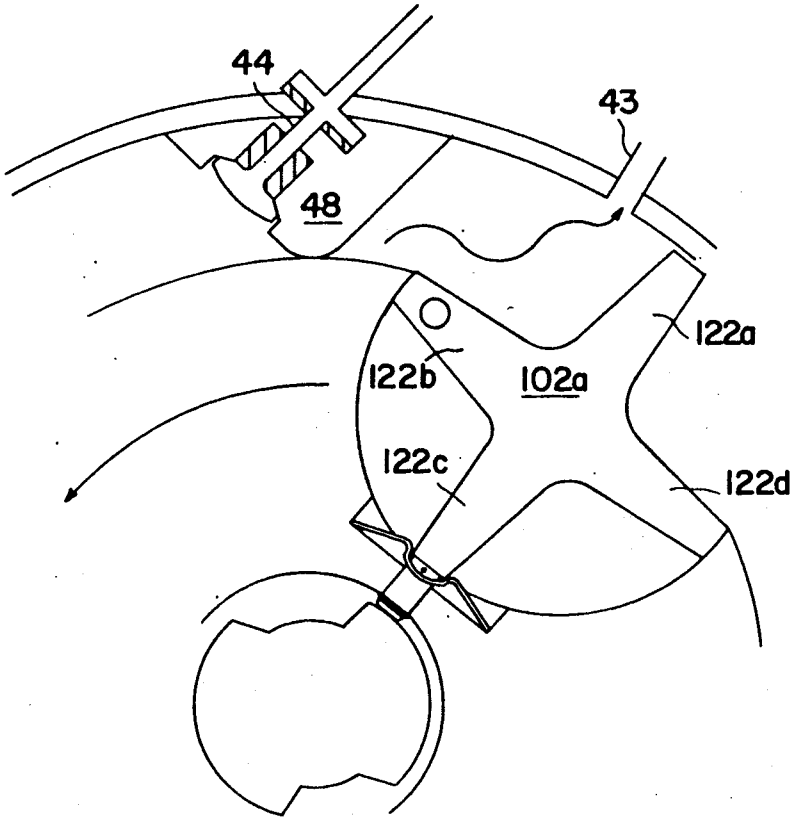
Figure 14D:
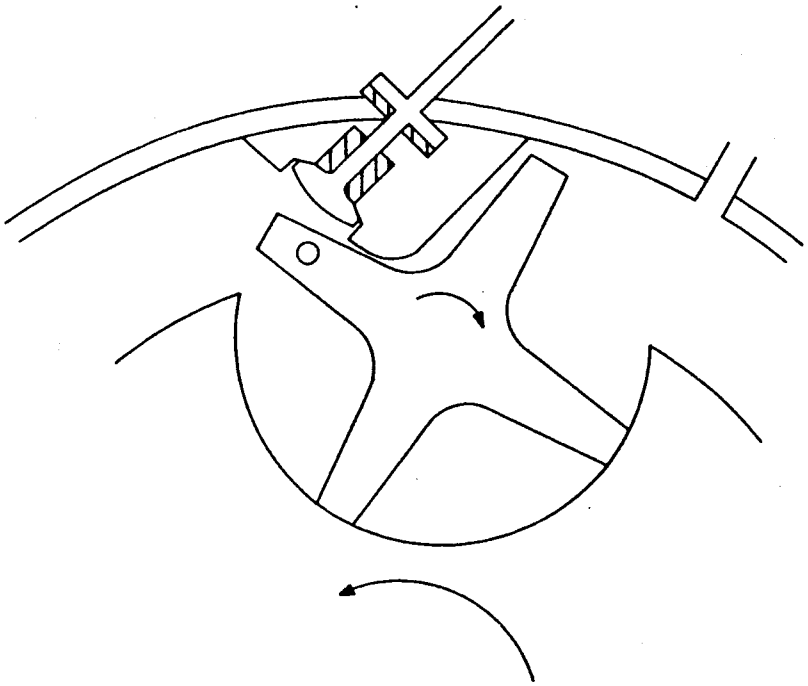
Figure 14C:
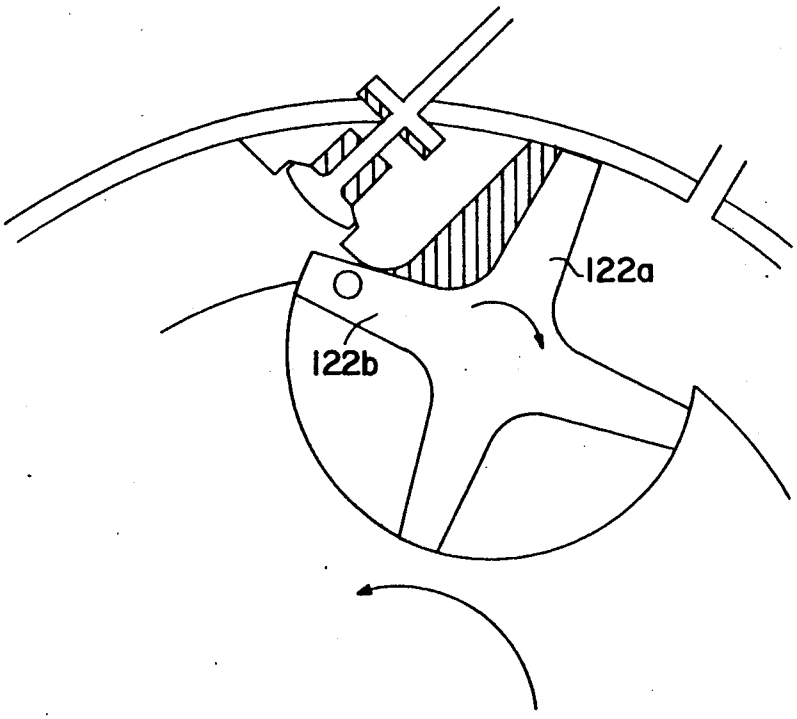
Figure 14F:
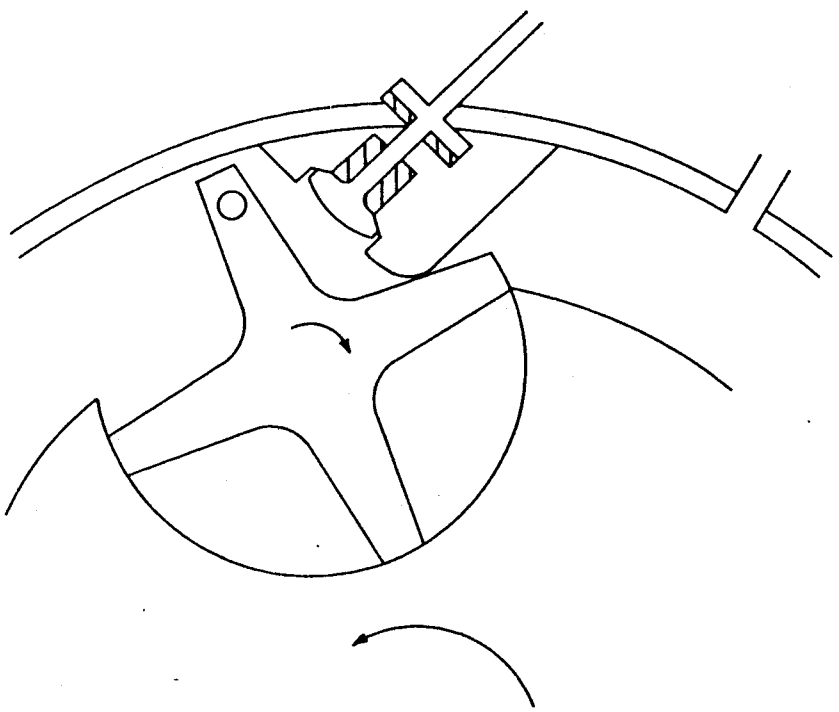
Figure 14E:
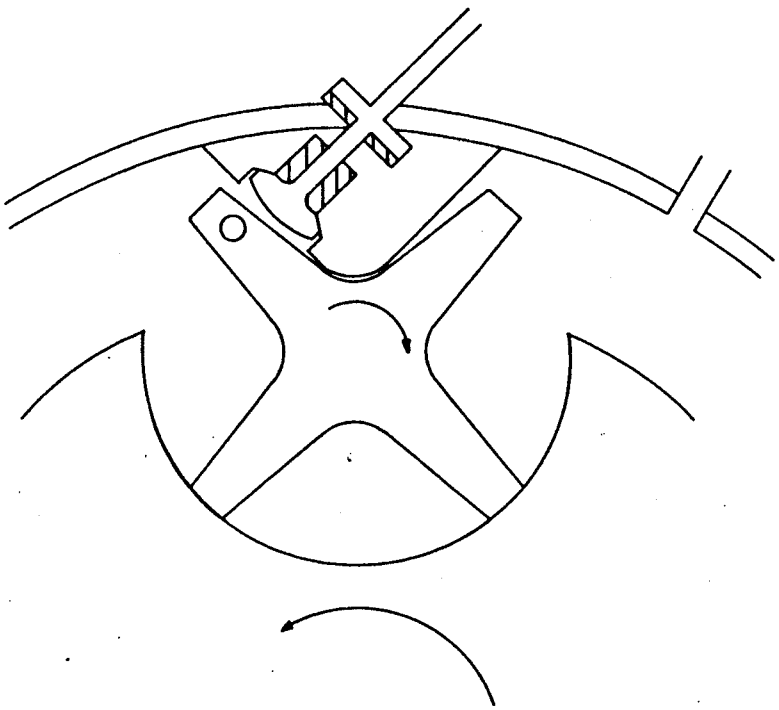

Referring to FIGS. 14*a* through 14*h*, the virtual piston 102*a* is in a balanced position and includes one lobe 122*a* which rides along the inner surface of the sleeve 22 as the piston approaches the exhaust port 43. The next preceeding lobe 112*b* engages the upper surface of the nest and the succeeding lobe 122*d* also engages the upper surface of the nest. The piston 102*a*, at this time, is maintained in this alignment primarily by pressure balance and for safety by the spring 114. As the shaft assembly continues in its counterclockwise direction, FIG. 14*b*, a volume $V_1$ is defined by the inner surface of the sleeve 22, the surfaces of the lobes 122*a* and 122*b* and the surface of the cylinder head 42 which is opposed to the surface of the lobe 110. The cam on the shaft 12 disengages from the plug 112 allowing the spring 114 to withdraw from the nest, freeing the piston. As the shaft assembly continues in its counterclockwise movement, FIG. 14*c*, the diminished volume $V_1$ and the unbalanced force on lobe 122*a* imparts a clockwise rotation to the virtual piston. The volume $V_1$ continues to diminish as the piston continues in its clockwise rotation, FIG. 14*d*. The piston continues in its clockwise rotation as shown in FIG. 14*f*.

Figure 14H:
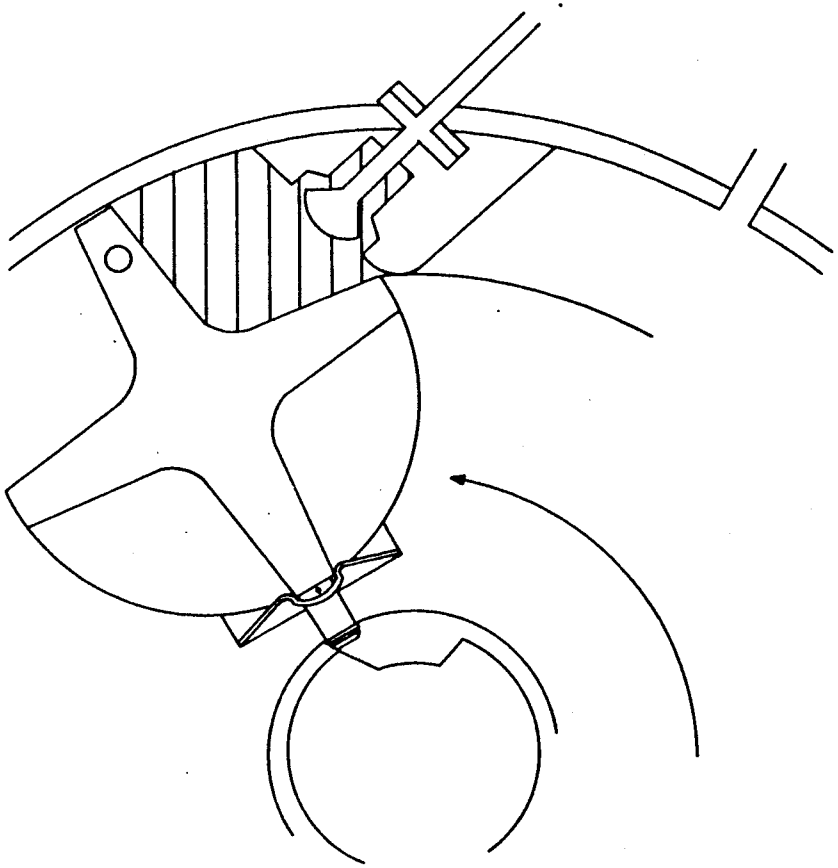
Figure 14G:
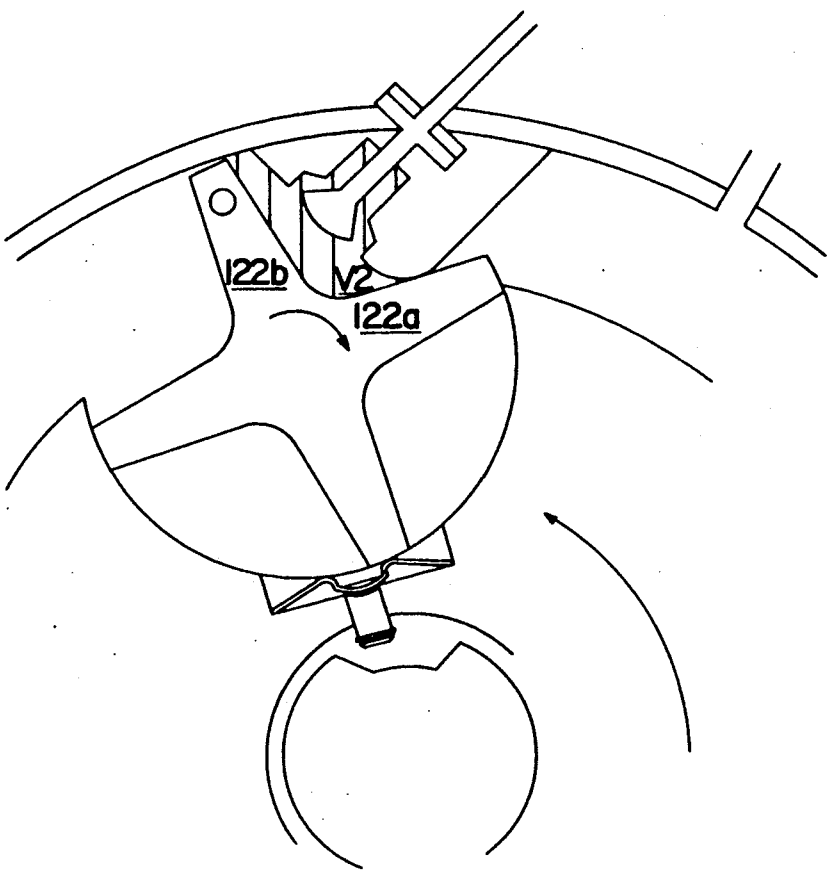

When the lobe 122*b* engages the inner surface of the sleeve 22 then the surfaces of the lobes 122*b* and 122*a* with the surface of the cylinder head opposed to the surface of the lobe 122*b* now define a volume $V_2$, FIG. 14*g*. At this time, steam is injected resulting in a retardation of the clockwise movement of the piston. The force acting on the piston is transferred to the nested shaft assembly as shown in FIG. 14*h*. In addition, the piston within the nest is now balanced. In the balanced power stroke the compressor forces are transferred directly to the shaft assembly. The timing of the injection of the steam is to ensure that before there is any metal contact, steam is admitted for the power stroke. After initiation completion of the power stroke and the alignment shown in FIG. 14*h*, the cam on the shaft 12 will engage the plug 112 to allow the spring 114 to engage the lobe in the bottom of the next until the piston can enter the phase of FIG. 14*b*.

It is important to note the profile of the virtual piston faces; they are flat and do not conform precisely to a continuance of the tri-nest diamater. This configuration allows for acceleration/deceleration to function as a ramp. A further explanation of the principal of the invention follows with reference to FIGS. 15*a* and 15*b*.

The four-lobed virtual piston has no tendancy to rotate about its center while it is transmitting a useful force to the tri-nests output power shaft assembly. This balance exists when the piston is not in contact with the cylinder head. Referring to FIG. 15*a*, Pascal's Law states that in a closed volume the pressure everywhere is the same. In the high pressure volume on the right, faces F1 and F2 experience the same pressure. In addition, the areas of the faces F1 and F2 are equal because of the symmetry designed into the piston. Since the force equals pressure times area the force on the face F1 equals the force on the face F2. Although the magnitudes of these forces are equal, their vectors are opposite. That is, the force on face F1 wants to rotate the piston counterclockwise and the force on face F2 wants to rotate the piston clockwise. The same condition exists on the left of the low pressure volume. Therefore, the piston is balanced about its center because of torque cancellation. The force, which results from the differential pressure across the singular, outward pointing lobe of the virtual piston is transmitted through to the tri-nest power output shaft assembly for useful work. The force on the face F1 is greater than the force on the face F3 because of the differential pressure existing across that lobe. Therefore, a torque is present causing the tri-nest assembly to rotate in a counterclockwise direction. There are no equal and opposite forces at the same distance, 180° away, with which to cancel this torque. While a single lobe of the four-lobed piston experiences a differential pressure creating useful torque for the tri-nest assembly, the piston itself does not rotate about its own center.

FIG. 15*b* shows the unbalanced mode. The seal in the cylinder head causes the area defined by $F_4$ in the closed volume to be less that area $F_3$. $F_3$ has not changed. The unbalance of the piston, about its own center, forces $F_4$ face against the seal and roller in the cylinder head. It is important that the piston have no tendancy to rotate while out of the engagement vicinity of the virtual cylinder head. Once the piston is in the engagement area of the cylinder head, unbalance occurs which is necessary for the virtual piston's intermittent action. Mechanical capture guarantees piston motion control during the unbalance mode. The mechanical capture is the way the cylinder head and the piston, together with its nest, cooperate to form the closed expansion volumes. The pressure in the forming volumes always tends to keep the cooperating face of the VP against the roller at the vertex of the cylinder head. This is one point of the mechanical capture, see FIG. 15*b*. The other two and then three capture points, in sequence, are the remaining tips of the piston riding in the nest. These are rotatable pedestals or supports for the VP while in the unbalanced mode. The balanced or free piston allows two important functions to occur, namely, shockless acceleration/deceleration by compression-/admission and high power to weight ratio.

The rotation of the piston 102, about its own center, must be accelerated from zero RPM to a velocity equivalent to that of the engine in a span one-half the diameter of the piston. The deceleration occurs in the other half. A ramp or gradual acceleration/deceleration is required to keep piston turning forces low to avoid shock. The configuration difference between the profile of the cord-like shape of the piston and outer diameter of the tri-nest 100 (shaded area in FIG. 16) allows for this ramp.

Referring to FIG. 16, for illustration, all velocities are given in percentages of V. V is the velocity of the engine; assumed to be constant. A distance equivalent to one diameter of the piston is sectioned into ten equal segments representing equal increments of time. The nine circles on the arc, which is a continuation of the tri-nest outside the diameter, indicate where progressive contact is made by the cooperating face with the vertex 56 of the virtual cylinder head. Although the time segments are equal, it can be seen that the angle changes are not. The angle changes at 7, 14, 32 and 37 degrees start small and get larger and then retreat in reverse order. Time segments 0–2 and 8–10 graph the gradual changes in velocity (acceleration) which provide the ramp for both start and stop action.

Having described my invention, what I now claim is:

1. A rotary steam engine which comprises:

a stationary sleeve having an inner surface and an outer surface and exhaust port formed in the sleeve; face plates each joined to an end of the sleeve; a power shaft rotatably received in the sleeve and extending through one of the face plates the power shaft carrying a nested assembly; cylinder heads having V-shaped walls secured to the inner surfaces of the sleeve located downstream of the exhaust ports with reference to the direction of rotation of the power shaft; virtual pistons received in the nests and adapted for movement in balanced and unbalanced modes, the pistons when in the unbalanced mode in free floating engagement in the nests; the pistons having lobes, the surfaces of which cooperate with the cylinder walls to define chambers; and means to introduce steam through the cylinder heads and into a chamber in timed sequence to effect a balanced power stroke whereby the force acting on the piston is transformed to the power shaft via the nested assembly while the piston remains balanced.

2. The engine of claim 1 wherein the cylinder head comprise:

means to bypass steam through the cylinder head to ambient; and wherein the cylinder head includes a vertex and said vertex comprises means to maintain rolling contact with an associated virtual piston for unbalanced contact forces only experienced during an acceleration/deceleration sequence.

3. The engine of claim 1 wherein the power shaft drives the means to introduce the steam into the cylinder heads.

4. The engine of claim 1 wherein the nested assembly is a tri-nested assembly, the nests are equally spaced apart and wherein there are two cylinder heads spaced 180° apart

5. The engine of claim 4 which includes:

means to control the orientation of the pistons during the balanced mode.

6. The engine of claim 4 wherein the pistons include:

means to form seals between the outer edges of the lobes and the inner surfaces of the nests and the inner surfaces of the sleeve.

7. The engine of claim 6 wherein the seals in the lobes are biased outwardly.

8. The engine of claim 7 which includes:

means to vary the biasing of the seals in relation to the rotation of the piston.

9. The engine of claim 5 wherein the means to control the orientation includes alignment assemblies in the lower portion of the nests.

10. The the engine of claim 2 wherein the means to bypass the steam through the cylinder head comprise a safety valve in the cylinder head.

11. The engine of claim 2 wherein the means to provide rolling contact comprises a roller received in the vertex of the cylinder head.

12. The engine of claims 5, or 6 wherein the cylinder heads and pistons are configured to effect counter rotation of the pistons, with reference to the rotation of the power shaft, when the pistons are in their unbalanced mode.

* * * * *